US010213791B2

(12) United States Patent
Klimenta et al.

(10) Patent No.: US 10,213,791 B2
(45) Date of Patent: Feb. 26, 2019

(54) SCREW CENTRIFUGE WITH AUXILIARY OUTER SCREW FLIGHT FOR WET MECHANICAL SEPARATION OF SOLIDS

(71) Applicant: ANDRITZ Technology and Asset Management GmbH, Graz (AT)

(72) Inventors: Stefan Klimenta, Osterwieck (DE); Johann Franc, Bergisch Gladbach (DE)

(73) Assignee: Andritz Technology and Asset Management GmbH, Graz (AT)

( * ) Notice: Subject to any disclaimer, the term of this patent is extended or adjusted under 35 U.S.C. 154(b) by 0 days.

(21) Appl. No.: 15/494,853

(22) Filed: Apr. 24, 2017

(65) Prior Publication Data

US 2017/0304846 A1 Oct. 26, 2017

(30) Foreign Application Priority Data

Apr. 26, 2016 (AT) ..... A 50367/2016

(51) Int. Cl.
*B04B 1/20* (2006.01)
*B04B 7/08* (2006.01)
*B04B 11/02* (2006.01)

(52) U.S. Cl.
CPC ..... *B04B 1/20* (2013.01); *B04B 7/08* (2013.01); *B04B 11/02* (2013.01); *B04B 2001/205* (2013.01); *B04B 2001/2041* (2013.01); *B04B 2001/2058* (2013.01)

(58) Field of Classification Search
CPC ... B04B 1/20; B04B 11/02; B04B 2001/2041; B04B 2001/205; B04B 2001/2058; B04B 11/00; B04B 7/08
USPC ..... 494/54
See application file for complete search history.

(56) References Cited

U.S. PATENT DOCUMENTS 2,919,848 A * 1/1960 Howe ..... B04B 1/20 494/42
4,037,781 A * 7/1977 High ..... B04B 1/20 494/51
5,342,281 A * 8/1994 Unkelbach ..... B03B 5/32 494/37

(Continued)

FOREIGN PATENT DOCUMENTS

AT 518275 B1 9/2017
DE 4222119 A1 * 1/1994 ..... B03B 5/32

(Continued)

*Primary Examiner* — Charles Cooley
(74) *Attorney, Agent, or Firm* — Alix, Yale & Ristas, LLP

(57) ABSTRACT

A screw centrifuge has a rotating, cylindrical drum (11) with openings (14,15) for discharge of settleable solids (16), floating solids (17), and separating liquid (18). A rotatable shaft (12) has openings (22) for infeed of the solids to be separated, and two sections of screw flights (13,13',13",23, 23') working in opposite directions. A baffle disc (20) is arranged on the shaft between the infeed opening (22) and the discharge opening (14) for the settleable solids (16). The flight (13',13") of the screw for the settleable solids (16) surrounds the flight (23,23') of the screw for the floating solids (17), and also work in opposite directions. The screw section for the floating solids (17) is designed as a multi-channel screw. The outer flight (13',13") of the screw for the settleable solids (16) can also have several channels.

13 Claims, 3 Drawing Sheets

(56) References Cited

U.S. PATENT DOCUMENTS

| | | | | |
|---|---|---|---|---|
| 7,153,255 | B2 * | 12/2006 | Gillengerten | B03B 5/32 494/53 |
| 2005/0107236 | A1 * | 5/2005 | Gillengerten | B03B 5/32 494/53 |
| 2017/0304846 | A1 * | 10/2017 | Klimenta | B04B 1/20 |

FOREIGN PATENT DOCUMENTS

| | | | | |
|---|---|---|---|---|
| DE | 4305346 | A1 * | 8/1994 | B03B 5/32 |
| EP | 1020227 | A1 * | 7/2000 | B03B 5/32 |
| JP | 2002186878 | A * | 7/2002 | B03B 5/32 |

* cited by examiner

SCREW CENTRIFUGE WITH AUXILIARY OUTER SCREW FLIGHT FOR WET MECHANICAL SEPARATION OF SOLIDS

BACKGROUND

The present invention relates to a screw centrifuge for wet mechanical separation of solids according to their density.

This is generally implemented by a rotating, cylindrical drum with two conical drums connected to it and openings for discharge of the separated material as settleable solids and floating solids and of the separating liquid. A rotating shaft with openings for infeed of the solids to be separated is provided, where the shaft has two screw flights working in opposite directions. A baffle disc is arranged on the shaft in axial direction between the infeed opening for the substances to be separated and the discharge opening for the settleable solids. The outer flight of the screw for the settleable solids surrounds the inner flight of the screw for the floating solids, and the flights work in opposite directions.

Screw centrifuges of this kind are known from EP 0 553 793 B1. Machines of this type have a limited throughput for the light or floating fraction. If the established throughput is increased, the machine becomes blocked with the product. Other similar machines are known from DE 195 16 636 A1 or EP 1485 205 B1. These types of machine are used for three-phase separation of substance mixtures, e.g. different plastic fractions and a separating liquid. By choosing suitable densities of separating liquid, it is also possible to separate into several different fractions in multi-stage processes. In addition, DE 3134935 A1 describes a decanter centrifuge for separating a solids phase and two liquid phases. In this case, it is not possible to separate a light or floating fraction. The decanter centrifuge in DE 2612696 also cannot separate floating solids. It separates floating and heavy solids that are deposited on or carried by gravity onto the inner circumference of the centrifugal drum. U.S. Pat. No. 2,528,974 describes a centrifugal separator for separating solids and liquids, but three-phase separation is not possible here either. The spiral separator in U.S. Pat. No. 4,781,822 separates two kinds of particles according to density or size.

SUMMARY

The object of the present invention is to achieve better separation and higher throughput in three-phase separation.

This is achieved in that the screw for the floating solids is designed as a multi-channel screw. With this feature, the throughput can be increased substantially while maintaining the same separation result and residual moisture in the product, and there is also a significant reduction in plugging/blocking of the machine in spite of the higher throughputs.

A favorable embodiment of the invention is characterized in that the screw flight for the settleable solids extends as far as the drum and the screw flight for the floating solids has a smaller outer diameter than the inner diameter of the screw flight for the settleable solids. With this measure and the two flights working in opposite directions, the light fraction that floats on the separating liquid can be transported from the inner flight to the light fraction discharge while the heavy fraction sinks, collects on the wall of the drum, and is transported by the outer flight to the discharge point at the opposite end. The separating liquid is discharged separately here through nozzles.

A favorable development of the invention is characterized in that the part of the screw flight for the settleable solids that surrounds the flight for the floating solids is also connected to it, preferably by welding. Thus, there are no additional supports required that could obstruct the path of the separated material.

An advantageous development of the invention is characterized in that the screw for the settleable solids is designed as a multi-channel screw. The total capacity of a screw can be increased by selecting suitable channels and pitch.

The quantity of product (the aggregate material in front of the flight) conveyed through the respective flight channel is significantly less than with a single-channel flight. This makes the process more stable as well as helping to separate the product fractions, transport the respective fraction, and separate it from the separating medium at significantly higher throughputs.

BRIEF DESCRIPTION OF THE DRAWING

Embodiments of the invention will now be described in the following in examples and referring to the drawing, where.

DETAILED DESCRIPTION

Figure 1:
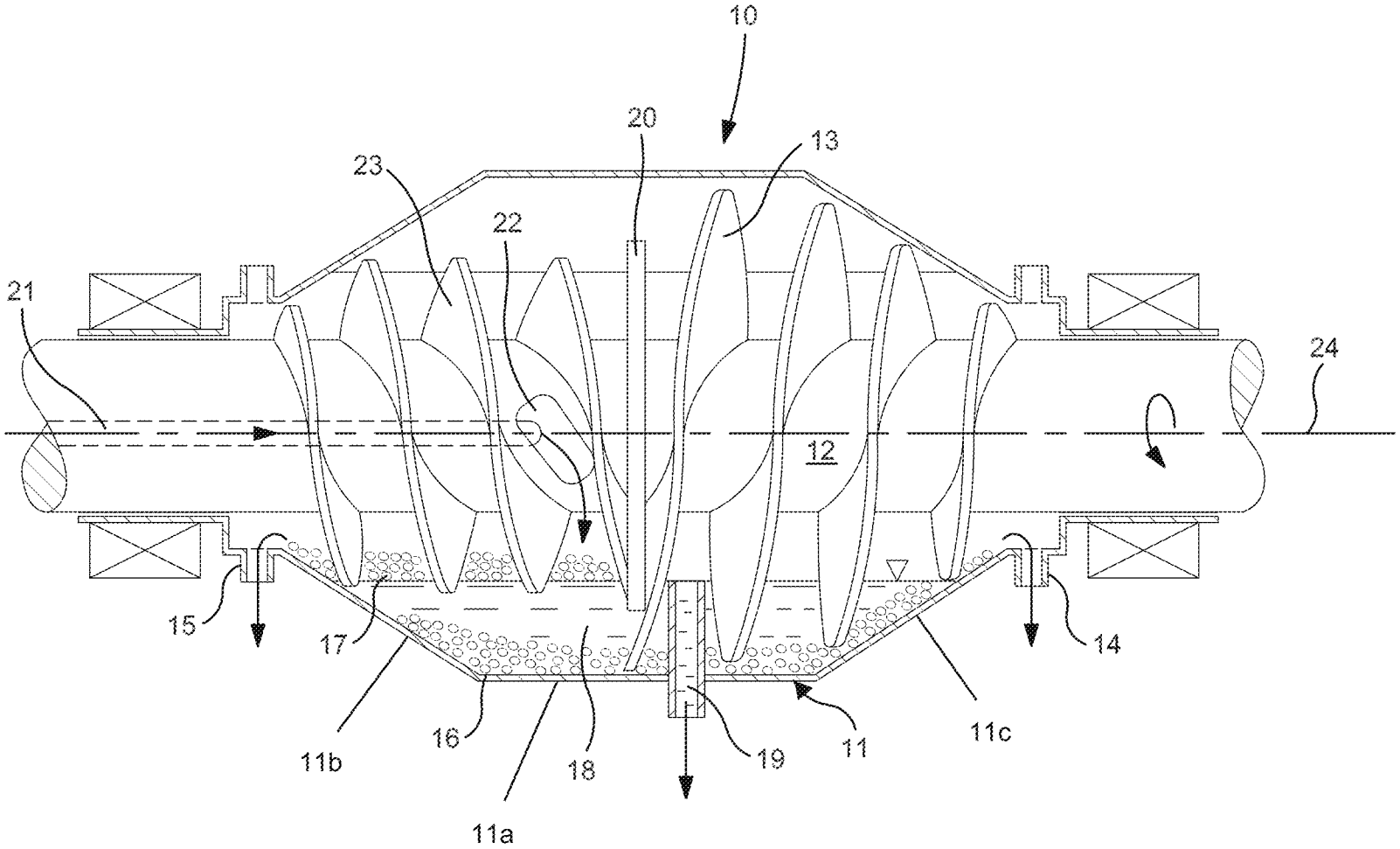
FIG.1 (PRIOR ART)
FIG. 1 shows a screw centrifuge according to the state of the art.

The known separating device 10 in FIG. 1 comprises a drum 11 having a central cylindrical portion 11*a* and axially opposed, inwardly tapered end portions, 11*b* and 11*c*. Inside the drum 11 there is a bipartite screw conveyor 12 with screw flights 13 for discharging the settleable solids (heavy fraction) 16 and screw flights 23 for discharging the floating solids 17. Due to the different arrangements of the screw flights, e.g. different outer diameter flights working in opposite directions, the settleable solids 16 and the floating solids 17 are conveyed to discharge openings 14, 15 at opposite ends of the device: the settleable solids 16 to one or several discharge openings 14 and the floating solids to one or several discharge openings 15. The separating liquid 18 removed from the settleable solids and the floating solids is discharged through one or several nozzles 19 on the heavy fraction side of the separating device 10. A baffle disc 20 prevents the floating solids 17 from being swept along by the flights 13 for the settleable solids 16 during the separation process and thus reaching the settleable solids discharge 14. The mixture of solids to be separated and separating liquid is fed into the inner part of the vessel via an axially arranged feed pipe pr passage 21 through one or several associated infeed openings 22, whereby during rotation of the drum the feed material is delivered to the inner wall of the drum 11. By rotating the drum 11 and the screw conveyor 12, the mixture, for example a suspension, is set in rotation and a centrifugal field is created in the suspension. The screw conveyor 12 is usually driven at a different speed to the drum. Due to the difference in density of the solids and the separating liquid, the solids are separated quickly, where the light solids (floating solids 17) float to the surface of the separating liquid 18 and the heavy solids (settleable solids 16) settle on the inner shell surface of the drum 11. The floating solids are then swept along by the screw flight 23 and conveyed to the discharge opening 15, the settleable solids 16 are swept along by the screw flight 13, conveyed to the discharge opening 14, then lifted out of the separating liquid and conveyed through the discharge opening 14 out of the drum 11 due to the tapered shape of the drum shell surface 11. The tapered part of the drum 11 at the discharge opening 15 facilitates separation of the floating solids 17 from the separating liquid 18.

Figure 2:
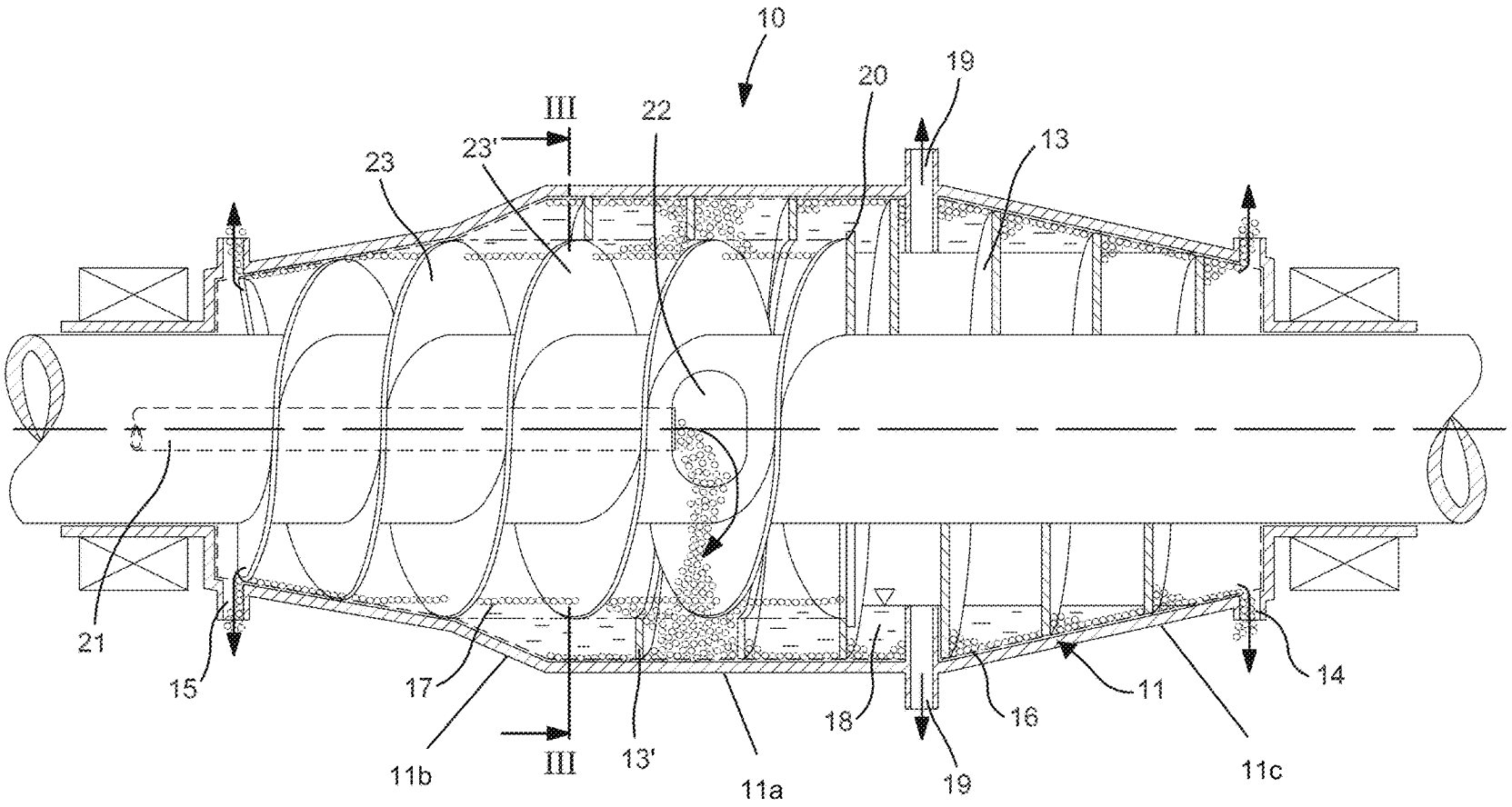
FIG. 2 shows a screw centrifuge according to the invention.

FIG. 2 shows a screw centrifuge according to one embodiment the invention, in a view corresponding to FIG. 1. The same parts are assigned the same reference numerals as in FIG. 1. In order to improve the throughput while maintaining the same separation selectivity and residual moisture content, additional, or auxiliary, parallel flights 13' are added as extensions to the flights 13 for transporting the settleable solids 16 to the discharge opening 14. This extension consists of one or several additional narrow (strip) flight(s) 13' arranged parallel to flight 13 and surrounding flight 23 (and 23') for the floating solids 17 (at least for a portion from adjacent to the baffle 20 to beyond the feed opening 22). The solids are separated more efficiently due to the flights working in opposite directions. The flight(s) 13, 13' is/are connected to flights 23, 23', for example welded, at various points. This provides support for the flights 13, 13', and there is no need for any separate supports, which could make the flight channels of the screw narrower and cause the machine to become plugged/blocked. The screw flight 23, 23' for the floating solids 17 is designed with two channels, which means that better conveying and thus a higher throughput can be achieved. The product to be processed (feed material) is often a mixture of plastics with different densities that are to be separated into floating and settleable solids. Depending on the application, fractionation results in separation selectivity that is significantly higher than 99% in the individual fractions. In addition to mixtures of different lumps of plastics or films, fibre materials such as carpet scraps and similar made of polypropylene, polyamide, and latex, can be separated in a two-stage process and thus recycled. In addition, the separated fibres undergo a certain degree of washing during the separation process before being discharged. To achieve even more effective separation, the two groups of screw flights for the settleable and floating solids can also be installed with the different pitches necessary for the process, depending on the specific requirements, which allows the machine to be tuned perfectly to suit the process.

Figure 3:
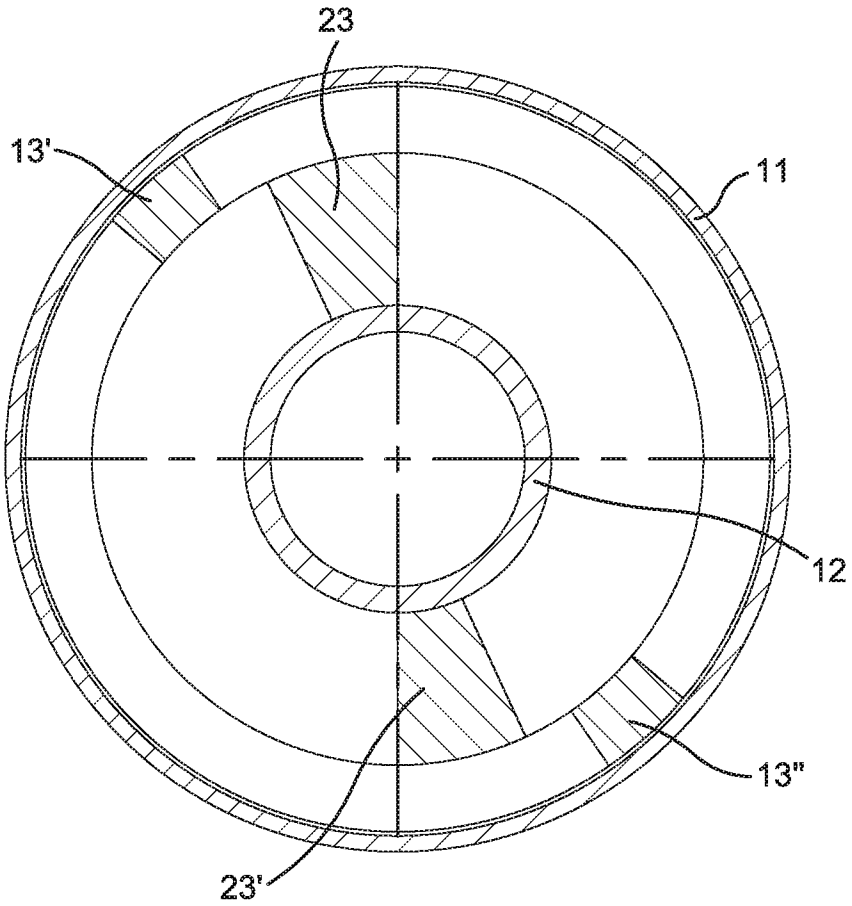
FIG. 3 shows a sectional view along the line marked III-III in FIG. 2.

FIG. 3 contains a sectional view along the line marked III-III in FIG. 2. It shows a sectional view here through the individual screw flights. The sectional view through the first flight 23 of the screw 12 for separating the floating solids 17 is shown in the top part. The bottom part depicts a sectional view through the second flight 23' for the floating solids. However, additional screw flights can also be used so that it then has three or more screw channels if necessary. The flight 13' for the settleable solids 16 is shown at the outer circumference. If the flight for the settleable solids 16 has a single channel, only the flight 13' as shown in the top section is present. If the flight has two channels, the flight 13" as shown in the lower part of the drawing is also present.

The invention is not limited by the examples in the drawings. The edges of the flights can also be protected against excessive wear by means of wear pieces.

In summary of the present disclosure, a screw centrifuge for wet mechanical separation of solids according to their density that has a rotating, cylindrical drum with two conical drums connected to it, with openings for discharge of the separated material as settleable solids and floating solids and of the separating liquid, and a rotating shaft with openings for infeed of the solids to be separated, where the shaft has two screw sections with respective flights working in opposite directions, where a baffle disc is arranged on the shaft in axial direction between the infeed opening for the substances to be separated and the discharge opening for the settleable solids. In addition, an outer flight of the screw section for the settleable solids surrounds a multi-channel flight of the screw section for the floating solids, where the flights work in opposite directions. The outer flight of the screw section for the settleable solids can also have several channels. This enables a particularly high throughput with continuing, high selective separation and the same low residual moisture content. The invention also relates to a screw conveyor for a screw centrifuge of this kind.

The invention claimed is:

1. A screw centrifuge for wet mechanical separation of solids according to density comprising:

a drum (11) with a cylindrical portion (11*a*), two tapered end portions (11*b*, 11*c*) and respective discharge openings (14,15) for separated material as settleable solids (16), floating solids (17) and separating liquid (18), and at least one nozzle (19) defining another discharge opening for discharging the separating liquid (18);

a rotating shaft (12) in the drum with at least one infeed opening (22) for infeed of the solids to be separated, and two screw flights working in opposite directions (13,13',13",23,23');

a baffle disc (20) arranged on the shaft and axially positioned between the at least one infeed opening (22) for the substances to be separated and the discharge opening (14) for the settleable solids (16) defining a heavy fraction side of the baffle disc (20) in the drum (11);

wherein the at least one nozzle (19) for discharging the separating liquid (18) is on the heavy fraction side of the baffle disc (20), and wherein an outer flight (13',13") of the screw for the settleable solids (16) surrounds an inner flight (23,23') of the screw for the floating solids (17), the inner and outer flights (13,13',13",23,23') work in opposite directions, and the screw for the floating solids (17) is a multi-channel screw.

2. The screw centrifuge according to claim 1, wherein the screw flight (13,13',13") for the settleable solids (16) extends radially to drum (11) and the screw flight (23,23') for the floating solids (17) has a smaller outer diameter than the inner diameter of the screw flight (13',13") for the settleable solids (16).

3. The screw centrifuge according to claim 1, wherein the screw flight (13',13") for the settleable solids (16) that surrounds the flight (23,23') for the floating solids (17) is directly connected to the surrounded flight.

4. A screw centrifuge for wet mechanical separation of solids according to density, comprising:

a rotatable drum (11) having a wall that includes a cylindrical wall portion (11*a*) and axially opposed, inwardly tapered wall portions (11*b*, 11*c*), a first of said tapered portions (11*c*) having a first discharge opening (14) for discharge of the separated material as settleable solids (16), a second of said tapered portions (11*b*) having a second discharge opening (15) for floating solids (17), and a third discharge opening (19) in the cylindrical portion for discharging the separating liquid (18);

a rotatable shaft (12) extending axially within the drum with an internal passageway (21) and associated infeed opening (22) for delivering the solids to be separated between the shaft and the drum wall, wherein the shaft (12) has a first screw section with flights (13,13',13") for transporting settleable solids toward the first discharge opening (14) and a second screw section with flights (23,23') working in opposite direction for transporting floating solids toward the second discharge opening (15);

a baffle disc (20) arranged on the shaft between the infeed opening (22) and the first discharge opening (14);

wherein the third discharge opening (19) is positioned on a side of the baffle disc (20) that is common with the first discharge opening (14) which defines a heavy fraction side of the baffle disc (20) in the drum (11), and wherein the second screw section for the floating solids (17) is a multi-channel screw and an auxiliary outer flight (13',13") of the first screw section surrounds some of the flights in the second screw section (22,23').

5. The screw centrifuge according to claim 4, wherein the auxiliary outer flight (13',13") for the settleable solids (16) extends radially beyond the baffle disc (20) to the wall of the drum (11) and the surrounded flights (23,23') of second screw section for the floating solids (17) have a smaller outer diameter than the inner diameter of the auxiliary outer flight (13',13").

6. The screw centrifuge according to claim 5, wherein the auxiliary outer flight (13',13") is directly connected to the surrounded flight (22,23').

7. The screw centrifuge according to claim 4, wherein the auxiliary outer flight (13',13") is directly connected to the surrounded flight (22,23').

8. The screw centrifuge according to claim 4, wherein the auxiliary outer flight (13,13') of the screw section for the settleable solids (16) is multi-channelled.

9. The screw centrifuge according to claim 4, wherein the auxiliary outer flight (13',13") is situated entirely between the baffle (20) and the second discharge opening (15).

10. A screw conveyor and drum for separating solids in a screw centrifuge, comprising:

a drum (11) defining an inner wall enclosing an interior, the drum having at least one nozzle (19) for discharging separating liquid (18) from the interior;

a rotatable shaft including an internal passageway (21) and associated infeed opening (22) for the solids to be separated;

a first flight (13,13',13") for transporting settleable solids in a first axial direction defining a heavy fraction side of the drum (11) and a second flight (23,23') working in a second direction opposite from the first flight for transporting floating solids in a second axial direction opposite from the first axial direction;

a baffle disc (20) arranged on the shaft between the first flight and the second flight; wherein the second flight for the floating solids (17) is multi-channelled, and the first flight includes an auxiliary outer flight (13',13") that extends over the baffle disc and surrounds a portion of the second flight (23,23') adjacent to the baffle disc, wherein the at least one nozzle (19) is positioned on the heavy fraction side of the drum.

11. The screw conveyor according to claim 10, wherein the auxiliary outer flight (13',13") is directly connected to the surrounded flight (22,23').

12. The screw conveyor according to claim 10, wherein the auxiliary outer flight (13',13") is multi-channelled.

13. The screw conveyor according to claim 10, wherein the auxiliary outer flight (13',13") extends beyond the feed opening (22).

* * * * *